US005228085A

United States Patent [19]

Aylward

[11] Patent Number: 5,228,085

[45] Date of Patent: Jul. 13, 1993

[54] PERCEIVED SOUND

[75] Inventor: J. Richard Aylward, West Newton, Mass.

[73] Assignee: Bose Corporation, Framingham, Mass.

[21] Appl. No.: 683,702

[22] Filed: Apr. 11, 1991

[51] Int. Cl.[5] ..... H04R 5/00

[52] U.S. Cl. ..... 381/1; 381/22; 381/24; 381/27

[58] Field of Search ..... 381/22, 24, 27, 1

[56] References Cited

U.S. PATENT DOCUMENTS 3,892,624 7/1975 Shimada ..... 381/24
5,005,201 4/1991 Rumreich et al. ..... 381/24
5,027,403 6/1991 Short et al. ..... 381/27

*Primary Examiner*—Jin F. Ng
*Assistant Examiner*—Edward Lefkowitz
*Attorney, Agent, or Firm*—Fish & Richardson

[57] ABSTRACT

A stereo audio system includes a plurality of drivers and a signal processor circuit. The signal processing circuit has at least a left channel input and a right channel input, and provides at least one processed signal on at least one output. The processed signal is characterized by a coefficient of proportionality representative of complex components of the signals on the left channel input and the right channel input. The coefficient of proportionality is at a maximum and minimum for the complex components on the left channel input and the right channel input being in phase opposition and phase coherence, respectively. Each of the signals on the left channel input, the right channel input, and the at least one output are received by at least one of the drivers, and each of the drivers receives at least one of the left channel input signal, the right channel input signal, and the processed signal. Each of the drivers produces an acoustic output that corresponds to a combination of all inputs received by the driver. The acoustic outputs produced by the drivers forms a combined acoustic output in a first direction and a combined acoustic output in at least a second direction transverse to the first direction. The ratio of the combined acoustic output in the first direction relative to the combined acoustic output in the second direction is at a maximum and minimum when the coefficient of proportionality is at a minimum and maximum, respectively.

19 Claims, 2 Drawing Sheets

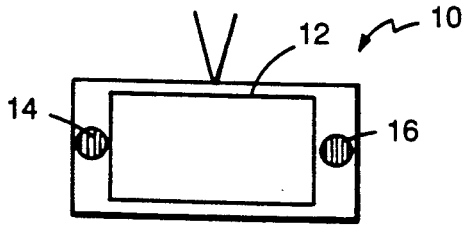
FIG. 1
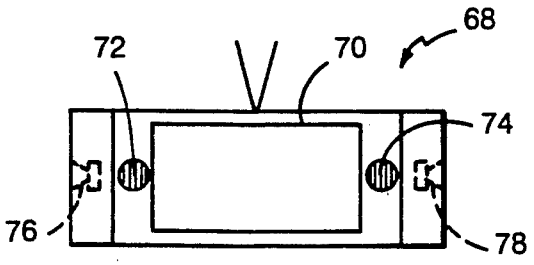
FIG. 3
FIG. 2
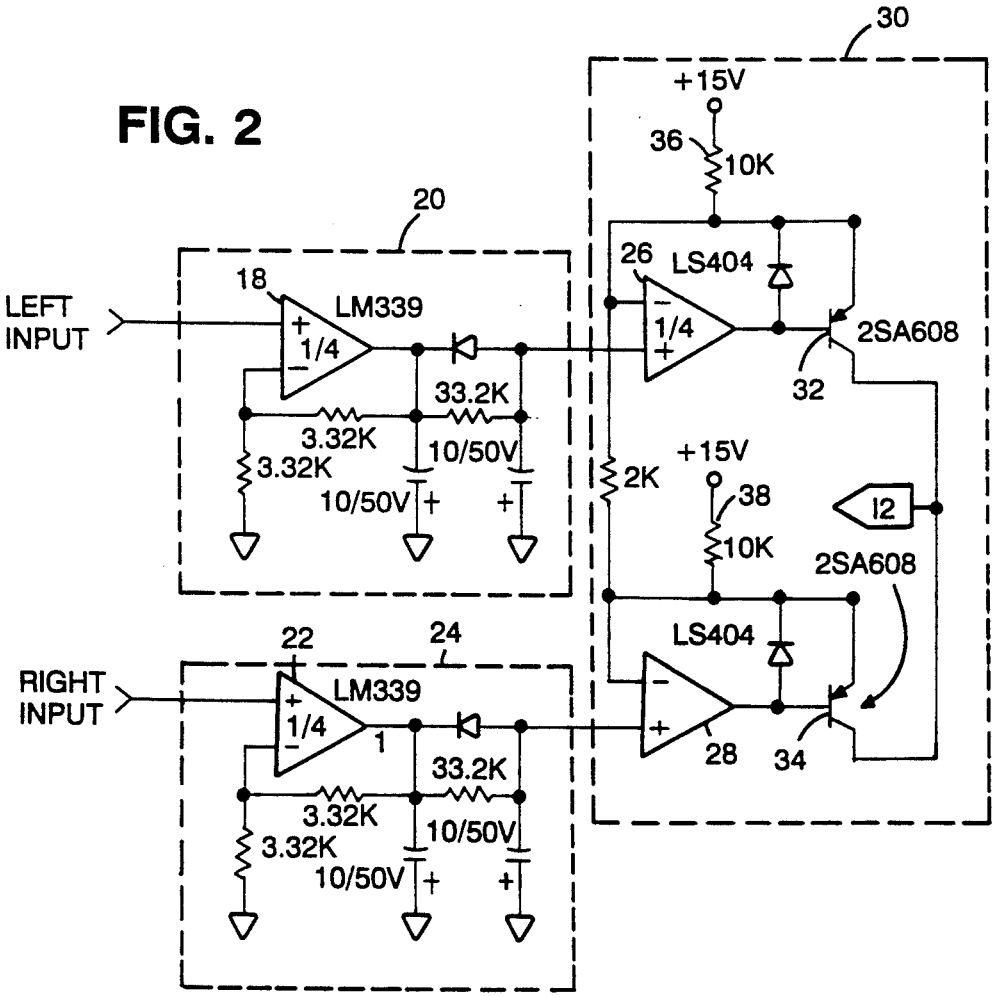

PERCEIVED SOUND

The present invention relates in general to signal processing for stereo audio systems and more particularly concerns signal processing for audio systems having front-firing direct radiators that are closely spaced, such systems being common in television receivers, table-top radio-frequency receivers, desk-top computer terminals, and similar devices.

Manufacturers of video-audio systems have improved upon the limited spatial performance of stereo loudspeakers by a variety of techniques. These techniques include processing of left and right channel stereo signals to form a difference signal (left minus right or right minus left) or both a difference signal and a sum signal (left plus right). The difference and sum signals can be selectively processed (usually emphasized), and mixed with the left and right channel stereo signals to provide processed left and right channel stereo signals, which are received by closely-spaced left and right drivers respectively. The object of such techniques is to produce a perceived stereophonic sound image that is wider than the spacing between two closely-spaced loudspeakers, one of which receives only a left stereo signal and the other of which receives only a right stereo signal. More elaborate techniques involve selective pre-emphasis of certain regions of the processed difference signal spectrum and selective pre-emphasis of certain regions of the processed sum signal spectrum.

When two enclosed loudspeakers whose individual radiation patterns are substantially omnidirectional are closely spaced with respect to each other, the loudspeakers exhibit a radiation pattern similar to that of an acoustic doublet when the loudspeakers are driven out-of-phase with each other with signals of equal magnitude. Most of the particle velocity occurs in directions that are perpendicular to the direction of motion of the loudspeaker cones (perpendicular to the direction in which the cones are aimed). The particle velocity in the direction of motion of the loudspeaker cones is nearly zero. In a listening environment having reasonable dimensions, a listener situated equidistant with respect to both loudspeakers and in the direction of motion of the loudspeaker cones would find it difficult to identify with precision the location of the actual acoustic sources, assuming that the signal source provides spectral components having wavelengths that are greater than the distance between the two loudspeakers. The listener would hear little energy directly from the loudspeakers, and would hear stronger, later reflections from the boundaries of the listening room.

Similarly, if the loudspeakers are driven out-of-phase with respect to each other, and the magnitude of the signal applied to one loudspeaker is greater (say, by 3 dB) than the magnitude of the signal applied to the other loudspeaker, the strength of one virtual image at the boundary of the listening room is greater than the strength of the other virtual image, and the relative positions of the virtual images is different as well. The energy directed directly from the loudspeakers to the listener would still be lower relative to the energy of the later reflections from the listening room boundaries, but not to the same extent as in the case when the signals at the left and right loudspeaker terminals are of equal magnitude. The apparent locations of the virtual acoustic images are dependent upon the relative difference in level between the magnitude of the first arrival energy (directly from the loudspeakers to the listener) and the late reflection energy (from the listening room boundaries) and dependent upon the time difference between the first and late arrivals.

If two closely-spaced loudspeakers are driven in phase with a signal having the same magnitude for both loudspeakers, the listener would have no difficulty in precisely identifying the location of the acoustic source. The first arrival energy would be substantially greater than the reflection energy from the boundaries of the room. By adjusting the relative magnitudes of the signals applied to the two loudspeaker terminals, the virtual acoustic image may be moved to the location of one or the other loudspeaker.

It is an important object of the invention to provide an improved signal processing system for stereo audio systems.

The invention provides a signal processing system that produces a perceived stereo sound image, when the left channel and right channel electrical signals are out of phase with respect to each other, that is substantially wider than the actual spacing of the left and right stereo drivers. When the left channel and right channel electrical signals are correlated (in phase with each other), however, the audio image is not wider than the actual spacing of the left and right stereo drivers. Because out-of-phase information is characteristic of stereophonic sound, and correlated, in-phase information is characteristic of monophonic sound, the invention permits monophonic information to be localized in the vicinity of the drivers themselves (as in the case of spoken dialogue on television) while permitting stereophonic information to be heard as a perceived sound image that extends beyond the space bounded by the drivers themselves.

According to the invention, there is a stereo audio system that includes a plurality of drivers and a signal processing circuit. The signal processing circuit has at least a left channel input and a right channel input, and at least one output to provide at least one processed signal. The processed signal has a coefficient of proportionality derived from complex information received on the left channel input and the right channel input. The coefficient of proportionality is at a maximum if the signals received on the left channel input and the right channel input are out of phase with each other, and is at a minimum if the signals on the left channel input and the right channel input are only in-phase, correlated signals. Each of the signals on the left channel input, the right channel input, and the at least one output are received by at least one of the drivers, and each of the drivers receives at least one of the signals on the left channel input, the right channel input, and the at least one output.

Each of the drivers produces an acoustic output that corresponds to a combination of all signals received by the driver. The acoustic outputs produced by the drivers forms a combined acoustic output in a first direction and a combined acoustic output in at least a second direction transverse to the first direction. The ratio of the combined acoustic output in the first direction relative to the combined acoustic output in the second direction is at a maximum when the coefficient of proportionality is at a minimum and is at a minimum when the coefficient of proportionality is at a maximum.

The processed output signal is preferably the signal on the left channel input minus the signal on the right channel input, multiplied by the coefficient of proportionality. The coefficient of proportionality preferably is a function of the difference between the average level of the signal on the left channel input and the average level of the signal on the right channel input divided by the average level of the difference between the signals on the left channel input and the right channel input. Each average level is preferably the average of peak values. The processed signal is preferably low-pass filtered.

The drivers preferably include a left forward driver and a right forward driver. The left forward driver receives the signal on the left channel input and the processed signal on the at least one output, and the right forward driver receives the signal on the right channel input and the inverse of the processed signal on the at least one output. The left forward driver and the right forward driver both have driver cones that are aimed in the first direction. The left forward driver and the right forward driver are located sufficiently close to each other so that the out-of-phase portions of the acoustic outputs of the left forward driver and the right forward driver tend to cancel each other acoustically in the first direction. The acoustic outputs of the left forward driver and the right forward driver tend to combine without acoustic cancellation in directions perpendicular to the first direction.

The coefficient of proportionality is at a minimum when the signals on the left channel input and the right channel input are only in-phase, correlated signals even if the correlated signals have a relative difference in amplitude. The coefficient of proportionality is also at a minimum if only the left channel input receives a signal and is at a minimum if only the right channel input receives a signal. Thus, when the left and right loudspeakers are adjacent to the left and right edges, respectively, of the video image being viewed, signal processing systems according to the invention enable a left only or right only electrical signal to be perceived as originating from the left or right channel loudspeaker, respectively, and not from a point in space that is beyond the left or right boundary of the video image. This feature preserves the vital link between picture and sound with regard to spoken dialogue. The visual and audio images reinforce each other because the invention coordinates perceived sound image location and viewed speaking image and prevents the dialogue from being heard from a point in space spaced from the viewed speaking image.

The drivers may further include a left side driver and a right side driver. The left side driver and the right side driver both have driver cones that are aimed perpendicular to the first direction. In this embodiment the processed signal is the right channel input signal minus the left channel input signal, multiplied by the coefficient of proportionality. The left forward driver receives the signal on the left channel input and the processed signal on the output, and the right forward driver receives the signal on the right channel input and the inverse of the processed signal on the output. The right side driver receives the processed signal, and the left side driver receives the inverse of the processed signal.

Numerous other features, objects, and advantages of the invention will become apparent from the following detailed description when read in connection with the accompanying drawings in which:

FIG. 1 is a drawing of a television receiver having left and right forward drivers, according to an embodiment of the invention;

FIG. 2 is a circuit diagram showing a portion of a signal processing circuit according to the invention;

FIG. 3 is a drawing of a television receiver having left and right forward drivers and left and right side drivers, according to another embodiment of the invention.

Figure 2A:
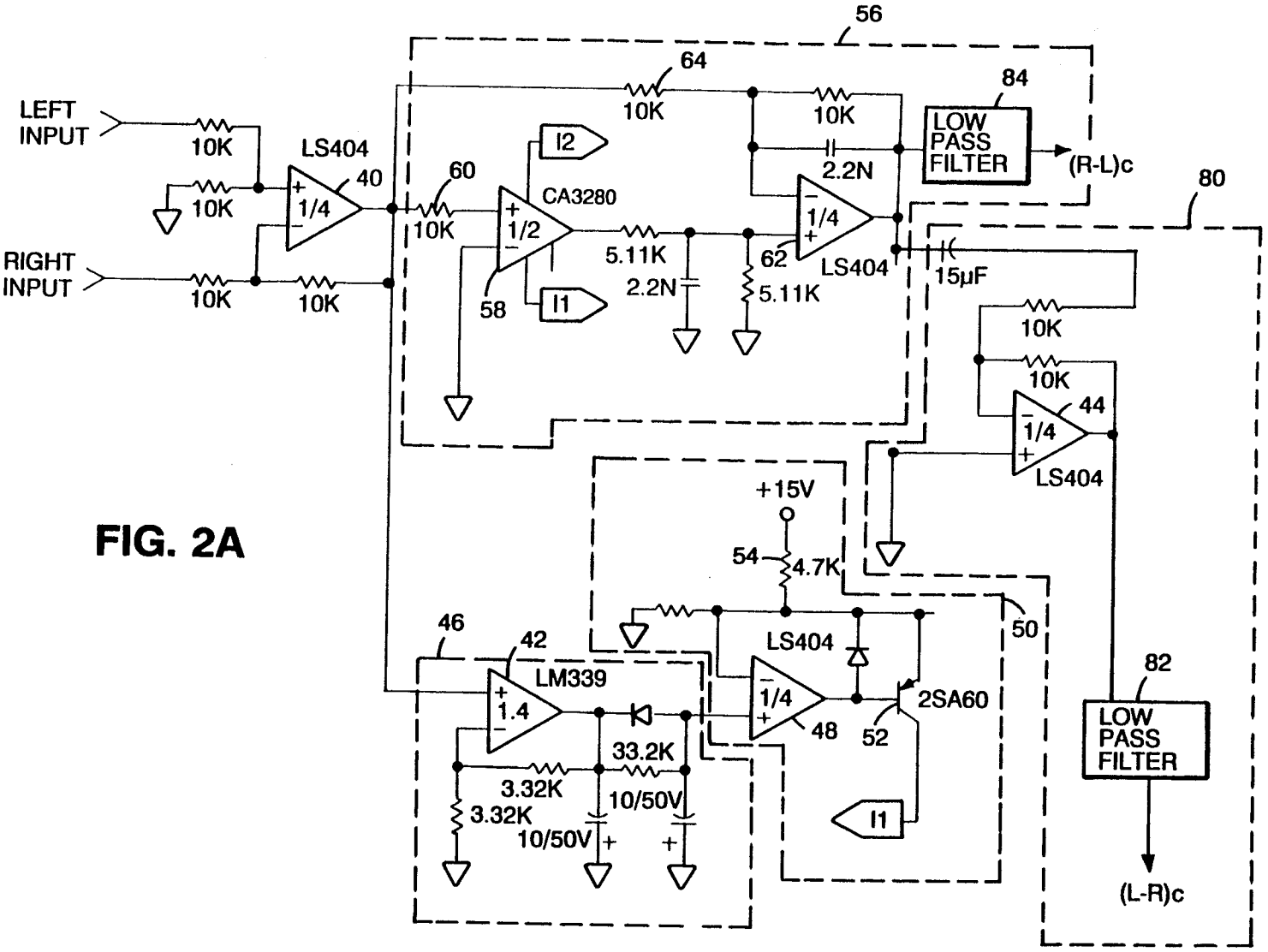
FIG. 2A is a circuit diagram showing the remaining portion of the signal processing circuit according to the invention.

With reference now to the drawings and more particularly FIG. 1 thereof, an audio-visual system 10 according to the invention has a picture tube display 12 or other suitable visual display device, a left speaker driver 14, and a right speaker driver 16. Left driver 14 and right driver 16, located immediately adjacent to the left and right edges, respectively, of display 12, receive electrical input signals from a signal processing circuit (described below in conjunction with FIGS. 2 and 2A), and produce corresponding audio outputs. Although an audio-visual system is shown, the invention may also be embodied in table-top radio receivers and other sound producers. The video display system typically displays moving images on the display in conjunction with left and right sound signals provided by the video display system coupled to left channel and right channel inputs, respectively, of the stereo audio system.

With reference to FIG. 2, there is shown a portion of a signal processing circuit according to the invention, in which a left channel line level input signal on the left input is received by open collector voltage comparator 18 in negative peak detection circuit 20. The voltage at the output of negative peak detection circuit 20 follows the left channel input signal until the left channel input signal attains a negative peak. The voltage at the output of negative peak detection circuit 20 then decays gradually in accordance with an RC time constant until the left channel input signal next becomes negative. The output of negative peak detection circuit 20 then begins to track the left channel input signal again. The output of negative peak detection circuit 20 is a rough indication of the average negative peak value of the left channel input signal. Similarly, a right channel line level input signal is received by open collector voltage comparator 22 in negative peak detection circuit 24. Circuits 20 and 24 need not necessarily be negative peak detection circuits, but could alternatively be root-mean-square detectors or average level detectors.

The outputs of negative peak detection circuits 20 and 24 energize operational amplifiers 26 and 28, respectively, in voltage-to-current conversion circuit 30. Circuit 30 converts the average negative peak values of the left and right channel input signals into a current I2 that is proportional to the absolute value of the difference in the averages of the absolute values of the peak values of the left and right channel input signals. Transistors 32 and 34, which have base-emitter junctions located within the feedback loops of operational amplifiers 26 and 28, respectively, perform this voltage-to-current conversion. The scale factor of the voltage-to-current conversion is typically 500 μamps per volt. Resistors 36 and 38 establish an arbitrarily small quiescent bias current for output current I2 in the absence of any left or right channel input signals.

With reference to FIG. 2A, there is shown the remaining portion of the signal processing circuit. Operational amplifier 40 receives signals on the left and right channel inputs to provide at its output a signal representing the instantaneous value of the left channel input signal minus the right channel input signal. This difference signal energizes open collector voltage comparator 42 in negative peak detection circuit 46. The output of negative peak detection circuit 46 is a rough indication of the average negative peak value of the left channel input signal minus the right channel input signal.

The output of negative peak detection circuit 46 energizes operational amplifier 48 in voltage-to-current conversion circuit 50. Transistor 52, which has its base-emitter junction located within the feedback loops of operational amplifier 48, performs the conversion to provide output current I1 from the collector of transistor 52. The scale factor of the voltage-to-current conversion is typically 500 μamps per volt. Resistor 54 establishes an arbitrarily small quiescent bias current for output current I1 in the absence of any input signal.

The output of operational amplifier 40 also energizes variable transconductance amplifier 58 and operational amplifier 62 through resistors 60 and 64, respectively. Currents I1 and I2 also energize variable-transconductance amplifier 58, which produces an output voltage that is equal to the input voltage on the + input multiplied by I2/I1, or $$\frac{||L_{in}| - |R_{in}|| + \epsilon 2}{|L_{in} - R_{in}| + \epsilon 1},$$

where $L_{in}$ is the left channel input signal, $R_{in}$ is the right channel input signal, $\epsilon 1$ is a small voltage due to the arbitrarily small quiescent current through resistor 54, and $\epsilon 2$ is a small voltage due to the arbitrarily small quiescent currents through resistors 36 and 38. The output of operational amplifier 62 is equal to ($L_{in}$–$R_{in}$) multiplied by a coefficient of proportionality:

$$(L_{in} - R_{in}) \cdot \left(1 - \frac{||L_{in}| - |R_{in}|| + \epsilon 2}{|L_{in} - R_{in}| + \epsilon 1}\right) \cdot -1$$

As explained below, the above expression is nonzero only when there is a difference in relative phase between the left and right channel input signals. The signal processing circuit thus functions as a phase discrimination mechanism that determines whether the L-R difference signal information is simple or complex.

The output of operational amplifier 62 energizes inverter circuit 80. The outputs of operational amplifier 62 and inverter 80 energize low pass filters 84 and 82, respectively, which provide (R-L)c and (L-R)c complex signals, respectively. The outputs of low pass filters 82 and 84 are combined with the left and right channel input signals so that the left driver receives the combination of $L_{in}$ and $(L\text{-}R)_c$ and the right driver receives the combination of $R_{in}$ and $(R\text{-}L)_c$.

The coefficient of proportionality, 1−(I2/I1), or $$1 - \frac{||L_{in}| - |R_{in}|| + \epsilon 2}{|L_{in} - R_{in}| + \epsilon 1},$$

is approximately zero when the left and right channel input signals are correlated information. $-(L\text{-}R)_c$ is then approximately zero. The precise nature and location of the sound source represented by the left channel and right channel input signals is then well-defined in the vicinity of the left and right forward drivers, respectively. The coefficients 1−(I2/I1) and $-(L\text{-}R)_c$ are approximately zero in the presence of a left-only or right-only input signal condition. The source represented by the left-only or right-only input signal is then localized at either the left forward driver or right forward driver respectively.

The coefficient 1−(I2/I1) approaches one as the amount of out-of-phase components in the left and right channel input signals increases, and is at a maximum when the signals present at the left and right channel inputs are in phase opposition and equal magnitude. Out-of-phase signal components characterize stereophonic sound. Because the left driver receives the combination of $L_{in}$ and $(L\text{-}R)_c$ and the right driver receives the combination of $R_{in}$ and $(R\text{-}L)_c$, the out-of-phase components cancel acoustically in the forward direction (the direction of motion of the loudspeaker cones). Meanwhile, the acoustic energy in directions perpendicular to the direction of motion of the loudspeaker increases to produce a perceived sound image that extends beyond the space between the outside edges of the left and right drivers (by virtue of reflections off of the walls of the listening environment). Because components of acoustic energy in phase opposition in the forward direction largely cancel while in-phase components of acoustic energy in directions perpendicular to the forward direction add so that the total radiated acoustic energy remains essentially constant, the signal processing according to the invention introduces relatively little change in the spectrum of the total acoustic energy that reaches the listener in adjusting the size and location of the perceived sound image.

Because current-controlled gain cell 56 is responsive to the ratio of currents I1 and I2, the gain created by current-controlled gain cell 56 is independent of the actual voltage levels of the signals on the left and right channel inputs, even though the described circuitry does not involve log domain processing. Consequently, the signal processing circuit introduces negligible audible artifacts over a reasonable dynamic range of input signal conditions.

At short wavelengths the two loudspeakers become uncorrelated sources. Filters 82 and 84 attenuate high frequency spectral components that might otherwise produce a harsh sound. Spectral components below approximately 100 Hz need not be processed according to the invention because these components do not contribute to perceived sound image location and size.

With reference to FIG. 3, another embodiment of an audio-visual system 68 according to the invention has a picture tube display 70 or other suitable visual display device, left forward driver 72, right forward driver 74, left side driver 76, and right side driver 78. Left and right forward drivers 72 and 74, which are located immediately adjacent to the left and right edges of display 70, respectively, and left and right side drivers 76 and 78, which face to the left and right, respectively, receive electrical input signals from the signal processing circuit and produce corresponding audio outputs. In particular, left forward driver 72 receives the combination of $L_{in}$ and $-(L\text{-}R)_c$, right forward driver receives the combination of $R_{in}$ and $-(R\text{-}L)_c$, left side driver receives an amplified $(L\text{-}R)_c$, and right side driver receives an amplified $(R\text{-}L)_c$.

In the embodiment of FIG. 3, the spacing between the left and right forward drivers is less significant, because these drivers do not receive difference components and do not produce acoustic cancellation. The embodiment of FIG. 3 radiates essentially uniform power without compensation of the spectrum of the left and right channels for variations in perceived sound image.

There has been described novel and improved apparatus and techniques for signal processing for stereo audio systems. It is evident that those skilled in the art may now make numerous uses and modifications of and departures from the specific embodiments described herein without departing from the inventive concept. Consequently, the invention is to be construed as embracing each and every novel feature and novel combination of features present in or possessed by the apparatus and technique herein disclosed and limited solely by the spirit and scope of the appended claims.

What is claimed is:

1. A stereo audio system comprising a plurality of drivers, and a signal processing circuit having at least a left channel input, a right channel input, and an output, and arranged to provide at least one processed signal on said at least one output, the at least one process signal which is a combination of the left channel input signal and the right channel input signal multiplied by a coefficient of proportionality representative of complex signal components received at said left channel input and said right channel input, the coefficient of proportionality being at a maximum and minimum when the complex components at the left channel input and the right channel input are in phase opposition and phase coincidence respectively and at a minimum that is approximately zero when only one of the left channel input and right channel input receives a signal, each of the left channel input signal, the right channel input signal, and the at least one processed signal being received by at least one of the plurality of drivers, each of the plurality of drivers receiving at least one of the left channel input signal, the right channel input signal, and the at least one processed signal, each of the plurality of drivers producing an acoustic output signal that corresponds to a combination of all input signals received by the driver, the acoustic output signals produced by the plurality of drivers forming a combined acoustic output in a first direction, and a combined acoustic output in at least a second direction transverse to the first direction that add so that the total radiated acoustic energy remains substantially constant independent of the ratio of acoustic outputs in the first and second directions, the ratio of the combined acoustic output in the first direction relative to the combined acoustic output in the second direction being at a maximum when the coefficient of proportionality is at a minimum and being at a minimum when the coefficient of proportionality is at a maximum.

2. A stereo audio system in accordance with claim 1, wherein the coefficient of proportionality is at a minimum when the left channel input and the right channel input receive only in-phase components independent of the amplitude of the components.

3. A stereo audio system in accordance with claim 1, wherein the processed signal comprises the difference between the left channel input signal and the right channel input signal, multiplied by the coefficient of proportionality.

4. A stereo audio system in accordance with claim 3, wherein the coefficient of proportionality is a function of the difference between the average level of the left channel input signal and the average level of the right channel input signal divided by the average level of the difference between the left channel input and the right channel input.

5. A stereo audio system in accordance with claim 3, wherein each average level is an average of peak values.

6. A stereo audio system in accordance with claim 3, wherein the plurality of drivers comprises a left forward driver and a right forward driver, the left forward driver receives the left channel input signal and the processed signal, and the right forward driver receives the right channel input signal and the inverse of the processed signal.

7. A stereo audio system in accordance with claim 6, wherein the processed signal comprises the left channel input minus the right channel input, multiplied by the coefficient of proportionality, the inverse of the processed signal comprises the right channel input minus the left channel input, multiplied by the coefficient of proportionality, the left forward driver and the right forward driver both have driver cones that are aimed in the first direction, the left forward driver and the right forward driver are located sufficiently close to each other that the out-of-phase portions of the acoustic outputs of the left forward driver and the right forward driver tend to cancel each other acoustically in the first direction, and the acoustic outputs of the left forward driver and the right forward driver tend to combine without acoustic cancellation in directions perpendicular to the first direction.

8. A stereo audio system in accordance with claim 6, wherein the plurality of drivers further comprises a left side driver and a right side driver, the left forward driver and the right forward driver both have driver cones that are aimed in the first direction, the left side driver and the right side driver both have driver cones that are aimed perpendicular to the first direction, the processed signal comprises the right channel input minus the left channel input multiplied by the coefficient of proportionality, the inverse of the processed signal comprises the left channel input minus the right channel input multiplied by the coefficient of proportionality, the right side driver receives the processed signal, and the left side driver receives the inverse of the processed signal.

9. A stereo audio system in accordance with claim 1, and further comprising at least one low pass filter intercoupling said output and at least one of said drivers.

10. A method of stereo signal processing left and right stereo signals, comprising the steps of combining said left and right signals to provide at least one processed signal, the at least one processed signal multiplied by a coefficient of proportionality representative of complex signal components in said left and right signals, the coefficient of proportionality being at a maximum and minimum respectively when the components are in phase opposition and phase coincidence respectively and at a minimum that is approximately zero when only one of said left and right signals is nonzero, transducing each of the left channel input, the right channel input, and the at least one processed signal with at least one of a plurality of transducers, each of the plurality of transducers transducing at least one of the left, right and the at least one processed signal, radiating from each of the plurality of transducers an acoustic output that corresponds to a combination of all the signals transduced by the transducer, the acoustic outputs transduced by the plurality of transducers forming a combined acoustic output in a first direction, and a combined acoustic output in at least a second direction transverse to the first direction that adds so that the total radiated acoustic energy remains substantially constant independent of the ratio of acoustic outputs in the first and second directions, the ratio of the combined acoustic output in the first direction relative to the combined acoustic output in the second direction being at a maximum when the coefficient of proportionality is at a minimum and being at a minimum when the coefficient of proportionality is at a maximum.

11. A stereo audio system in accordance with claim 10, wherein the coefficient of proportionality is at a minimum when the left channel input and the right channel input contain only in-phase, correlated signals even if the correlated signals have a relative difference in amplitude.

12. A method in accordance with claim 10, wherein the processed signal comprises the difference between the left channel input and the right channel input, multiplied by the coefficient of proportionality.

13. A method in accordance with claim 12, wherein the coefficient of proportionality comprises the difference between the average level of the left channel input and the average level of the right channel input, divided by the average level of the difference between the left channel input and the right channel input.

14. A method in accordance with claim 12, wherein each average level is an average of peak values.

15. A method in accordance with claim 12 and further including, positioning the plurality of transducers to form a left forward-facing transducer and a right forward-facing transducer, the left forward-facing transducer transducing the left signal input and the processed signal, and the right forward-facing transducer transducing the right signal input and the inverse of the processed signal.

16. A method in accordance with claim 15, wherein the processed signal comprises the left channel input minus the right channel input, multiplied by the coefficient of proportionality, the inverse of the processed signal comprises the right channel input minus the left channel input, multiplied by the coefficient of proportionality, the left forward driver and the right forward driver both have driver cones that are aimed in the first direction, the left forward driver and the right forward driver are located sufficiently close to each other that the out-of-phase portions of the acoustic outputs of the left forward driver and the right forward driver tend to cancel each other acoustically in the first direction, and the acoustic outputs of the left forward driver and the right forward drier tend to combine without acoustic cancellation in directions perpendicular to the first direction.

17. A stereo audio system in accordance with claim 15, wherein the plurality of drivers further comprises a left side driver and a right side driver, the left forward driver and the right forward driver both have driver cones that are aimed in the first direction, the left side driver and the right side driver both have driver cones that are aimed perpendicular to the first direction, the processed signal comprises the right channel input minus the left channel input, multiplied by the coefficient of proportionality, the inverse of the processed signal comprises the left channel input minus the right channel input, multiplied by the coefficient of proportionality, the right side driver receives the processed signal, and the left side driver receives the inverse of the processed signal.

18. A method in accordance with claim 10, further comprising the step of low-pass filtering the processed signal.

19. A stereo audio system in accordance with claim 1 and further comprising, a video display system that displays moving images on a display having left and right edges in conjunction with left and right sound signals provided by said video display system, said plurality of drivers closely adjacent to said left and right edges symmetrical about said display, said left and right sound signals being coupled to said left channel input and said right channel input, respectively, whereby the sound image perceived by a listening viewer of said display from a viewed image then represented as emitting sound originates from said viewed image.

* * * * *